US005634305A

United States Patent [19]

Erlanger

[11] Patent Number: 5,634,305

[45] Date of Patent: Jun. 3, 1997

[54] SYSTEM FOR STONE CLADDING OF BUILDINGS

[76] Inventor: Israel Erlanger, 12 Merachem Mashiv Street, Jerusalem, Israel

[21] Appl. No.: 347,404

[22] PCT Filed: May 18, 1993

[86] PCT No.: PCT/GB93/01006

§ 371 Date: Nov. 17, 1994

§ 102(e) Date: Nov. 17, 1994

[87] PCT Pub. No.: WO93/23637

PCT Pub. Date: Nov. 25, 1993

[30] Foreign Application Priority Data

May 18, 1992 [IL] Israel ..... 101911
Nov. 25, 1992 [IL] Israel ..... 103876

[51] Int. Cl.[6] ..... E04H 1/00
[52] U.S. Cl. ..... 52/235; 52/508
[58] Field of Search ..... 52/235, 508, 512, 52/236.3, 242

[56] References Cited

U.S. PATENT DOCUMENTS

| | | | |
|---|---|---|---|
| 3,621,635 | 11/1971 | De Lange | 52/235 |
| 4,070,835 | 1/1978 | Reverend et al. | 52/235 |
| 4,522,003 | 6/1985 | Akihama et al. | 52/391 |
| 4,551,958 | 11/1985 | Reneault et al. | 52/309.4 |
| 4,625,481 | 12/1986 | Crandell | 52/235 |
| 4,765,107 | 8/1988 | Ting | 52/235 |
| 4,765,111 | 8/1988 | Osawa | 52/509 |
| 4,803,821 | 2/1989 | Funaki | 52/387 |
| 4,866,896 | 9/1989 | Shreiner et al. | 52/235 |
| 4,987,712 | 1/1991 | Mancuso | 52/387 |

FOREIGN PATENT DOCUMENTS

| | | |
|---|---|---|
| 7981075 | 10/1976 | Australia . |
| 0190377 | 8/1986 | European Pat. Off. . |
| 2559819 | 8/1985 | France . |
| 092423 | 11/1989 | Israel . |
| 2108173 | 5/1983 | United Kingdom . |

OTHER PUBLICATIONS

Prefabrication and New Building Techniques, Jan. 1954, NA 8480.A1P7 pp. 22–28.

*Primary Examiner*—Carl D. Friedman
*Assistant Examiner*—W. Glenn Edwards
*Attorney, Agent, or Firm*—Leydig, Voit & Mayer

[57] ABSTRACT

A system for stone cladding of building includes a plurality of facing blocks arranged as superposed courses. Each block in a first course has a first step defining a lower tread, a riser, and a top tread extending along the length of the top surface of the block. Each block in a second course disposed above the first course has a second step complementary to the first step and extending along the length of the bottom surface of the block and configured to interfit with the first step of a block in the first course. A plurality of horizontally-extending vertically spaced rails are attached to a wall which is to be faced. The rails directly or indirectly support the facing blocks by overriding the top tread and riser of blocks in the first course and underlying and supporting the bottom surface of blocks in the second course. A concrete layer may be poured between the facing blocks and the wall.

22 Claims, 4 Drawing Sheets

SYSTEM FOR STONE CLADDING OF BUILDINGS

The present invention relates to a system and method for cladding building walls, and to prefabricated walls prepared therefrom.

Wall cladding is carried out on buildings to meet a number of design objectives. Provision of durability is the prime requirement when cladding facing walls made of foamed plastic materials or lightweight cement blocks. Improvement of appearance and compliance with local building codes are the requirements when cladding concrete walls. In addition, wall cladding always provides improved thermal and accoustic insulation and weather resistance, Thus, e.g., U.S. Pat. Nos. 4,070,835, 4,625,481 and 4,866,896 relate to various systems for securing cladding panels to a wall. U.S. Pat. Nos. 3,621,635 and 4,551,958 respectively teach the mounting of an aggregate textured type wall covering panel and a polystyrene foam panel and U.S. Pat. Nos. 4,522,003 and 4,803,821 teach arrangements for attaching tiles to external walls.

Many buildings, even today, are built using simple rectangular slabs as facing blocks, which blocks are anchored and attached to each other by a layer of cement at the rear of and between the edges of the blocks. This system has been found to be dangerously unreliable for high buildings, which tend to sway under pressure from wind and minor earth tremors; the resulting loosening of facing blocks can cause injury or death to persons in the vicinity of such buildings. In Jerusalem, following the highly dangerous fall of a number of facing blocks from clad buildings to pedestrian areas, the municipality has forced the owners of such buildings to take emergency action to secure facing blocks thereto. Such emergency measures are expensive and disruptive of normal activities; it is, of course, far better to properly secure the facing blocks during construction.

Thus, e.g., U.S. Pat. No. 4,987,712 teaches a brick cladding system including a metal strip from which there is punched a plurality of mounting flanges, the mounting flanges receive "brick" tiles which have side slots which receive the mounting flanges in order to secure the tiles to the mounting plate.

The traditional method of cladding buildings in Jerusalem and environs in stone consists of laying a few courses of stone which act as external formwork, and casting a concrete backing. This proceeds at a slow rate and delays the completion of the outside shell, further delaying the trades that follow.

When an existing wall has to be clad, a steel mesh is attached, the mason again lays a few courses, drills holes in each stone and with galvanised wires attaches it to the mesh. Concrete is then poured between stone and wall.

After the stonework is done, a separate operation of cleaning out the joints, sometimes damaging the wire ties, is undertaken and then the joints are caulked.

These antiquated methods have many drawbacks. They are slow, labour-intensive and inefficient and will probably not stand up adequately to lateral dynamic forces, e.g., earthquakes. As it is, there are many incidences of stones becoming dislodged and endangering passersby. Some high-rise buildings in Jerusalem have been condemned and a costly mechanical attachment system is called upon to correct the situation.

There is also the problem of water penetration in buildings clad by these methods. There are innumerable buildings built by reputable contractors which suffer from damp walls.

In order to deal with the problem Israel Patent 92433 describes a dry system of cladding which uses stepped interfitting building stones and bridging members as brackets. This system requires individual attachment of each bridging bracket to an associated facing stone and to the wall being faced, an arrangement requiring some skill and consuming considerable time during construction.

Many of the systems mentioned require that the wall to be faced be drilled for purposes of attachment at fixed intervals, typically once or twice for every facing block. This may, however, cause difficulty, as a cast wall may already contain water or drainage piping or electric conduits, and is very likely to contain steel reinforcing rods. It is, of course, necessary to avoid damaging these components when drilling. A system providing a choice of drilling sites is therefore superior to a system requiring drilling at fixed intervals.

Furthermore, most known systems make no provision for cladding existing stepped or sloping walls, and are unsuitable for the facing of walls constructed of foamed plastic.

To achieve fast construction on the building site, labour-intensive operations should be confined to the factory manufacturing the components to be used it is economically important that construction progresses quickly, mainly using unskilled labour.

It is therefore one of the objects of the present invention to obviate the disadvantages of the prior art cladding systems, and to provide a system which enables unskilled workmen to quickly erect cladding on an existing wall.

It is further object of the present invention to provide a cladding system which is rapidly erected and which achieves the completion of the clad wall by the pouring of concrete, and may therefore be referred to as a "wet" system. The poured concrete joins the cladding blocks to an existing wall and to each other thereby assuring the stability of the cladding surface.

It is yet another object of the invention to provide a system suitable for facing foamed plastic walls, such as those made of foamed polystyrene or foamed polyurethane.

Lastly, it is an object of the present invention to provide a facing stone which may be used in the described system as well as in other systems.

The present invention achieves these objectives by providing a system for stone cladding of buildings, comprising:

a plurality of facing blocks arranged as superposed courses, each block in a first course having a first step defining a lower tread, a riser, and a top tread surface extending along the length of the top surface of said block and each block in each further course being further provided with a complementary second step extending along the length of the bottom surface thereof and configured to interfit with said step of a block positioned thereunder; a plurality of horizontal-axis, vertically spaced-apart rails, configured to be attachable to the wall which is to be faced, each rail being provided with means for directly or indirectly positioning and supporting a plurality of said facing blocks by overriding the top tread surface and riser of a block positioned therebelow while underlying and supporting a bottom surface of an upper block positioned thereabove; and a concrete layer poured between said blocks and said wall.

In a first embodiment of the present invention there is provided a plurality of horizontal-axis, vertically spaced-apart rails, configured to be attachable to the wall which is to be faced, each rail being provided with a lip having its open side facing upwards; and at least one connector bracket attached to each block, said connector bracket being provided with a downwardly-projecting extension configured to be engageable to said lip in said rail and, when engaged, holding said block firmly to said rail.

Preferably said connector brackets support the facing block directly above, and cause the formation of a small space between each block and the block vertically below, said space being subsequently filled by the ingress of concrete from said poured layer.

In especially preferred embodiments of the present invention no intermediary connector brackets are required and said rail is provided with a retention ledge configured to underlie a bottom surface of an upper block as well as overriding the top tread surface of a block positioned thereunder and is further provided with a lower retention lip projecting downwardly therefrom and exceeding the height of the riser of a block positioned thereunder whereby said block may be inserted, lowered into and retained between a lower retention lip of an upper rail and a retention ledge of a lower rail, and may be removed therefrom after lifting said block above said retention ledge.

In especially preferred embodiments of the present invention said facing block is further provided with a third step along a first side edge, coplanar and contiguous to said first step; and a fourth step along a second side edge, coplanar and contiguous to said second step; said third step being configured to interfit with said fourth step of an adjacent similar block.

A major advantage of this preferred embodiment is that it facilitates the carrying out of a preferred method for stone cladding of buildings comprising a. providing a multiplicity of facing blocks, a first plurality of said blocks having a first step defining a lower tread, a riser and a top tread surface extending along the length of the top surface of said block and a second plurality of said blocks being further provided with a complementary second step extending along the length of the bottom surface thereof and configured to interfit with said first step of a block positioned thereunder; said blocks being further provided with a third step along a first side edge, coplanar and contiguous to said first step; and a fourth step along a second side edge, coplanar and contiguous to said second step; said third step being configured to interfit with said fourth step of an adjacent similar block;

b. providing a plurality of rails configured to be attachable to the wall which is to be faced, each rail being provided with means for directly or indirectly positioning and supporting a plurality of said facing blocks; by overriding the top tread surface and riser of a block positioned therebelow while underlying and supporting a bottom surface of an upper block positioned thereabove;

c. attaching a plurality of horizontal-axis vertically spaced-apart rails to a wall to be faced;

d. laying a first course of facing blocks upon a suitable base with at least an upper surface of each block being directly or indirectly engaged, retained and positioned by a first rail relative to said wall;

e. laying a second course of facing blocks upon said first courser with both an upper surface and a lower surface of each block being directly or indirectly engaged, retained and positioned relative to previously laid blocks and to said wall by a pair of spaced-apart rails; and f. pouring concrete between said wall and the rear surfaces of said facing blocks, wherein the interengagement of said first step and second step of vertically aligned blocks and the interengagement of said third step with said fourth step of horizontally aligned adjacent blocks results in said blocks forming a formwork surface which prevents seepage of said poured concrete to the outer surface of said blocks.

In preferred embodiments of the invention said facing blocks are further provided with a groove extending along the length of the bottom surface thereof, a wall of said groove being in contiguity with the riser of said second step, and wherein said rail is provided with a retention ledge configured to underlie a bottom surface of an upper block as well as overriding the top tread surface of a block positioned thereunder and is further provided with a lower retention lip projecting downwardly therefrom and exceeding the height of the riser of said block positioned thereunder as well as being provided with an upward projection coplanar with and contiguous to said lower retention lip, said upper projection being positioned and sized to engage the grooves of a plurality of facing blocks placed side by side thereabove.

Preferably said upper retention ledge and said upward projection support the facing block directly above, and cause the formation of a small space between each block and the block vertically below, said space being subsequently filled by the ingress of concrete from said poured layer.

As will be realized the provision of a plurality horizontal rails onto which the facing blocks can be readily hooked by unskilled laborers after which the constructed cladding wall is completed by a concrete layer poured between the wall being clad and the cladding blocks facilitates fast on-site construction coupled with the provision of a secure and stable cladding surface.

As will be noted U.S. Pat. No. 3,621,635 teaches an aggregate textured type wall construction which includes inter alia the use of horizontally arranged vertically spaced apart support strips having an upwardly directed flange portion to fort an upwardly opening hook. Said system shown, is a dry system as opposed to the "wet system" of the present invention and since this patent is specifically directed the mounting of panels of the type formed of a thin, substantially rigid base sheet having its outer exposed face covered with a thin coating of an aggregate type material bonded thereto it is very limited in its teachings and in fact provides as a main feature of the invention "a number of panel mounting strips, arranged upon the rear faces of each of the panels, and each having a base portion fastened only to said base sheet by a mechanical fastening means which are applied prior to application of the coating and which are covered and concealed by said coating, and an integral, downwardly extending hook-like flange fitted into and supported by an adjacent support strip hook thereby mounting the panel upon the supporting surface."

Therefore said patent neither teaches nor suggests the system and method of the present invention.

Similarly U.S. Pat. No. 4,987,712 teaches a mounting plate for a brick cladding assembly, which assembly includes a plurality of tiles to be supported by the plate, with each tile having a pair of parallel edge faces, and with each edge face having a slot so that the slots are parallel, said plate being of a generally planar rectangular configuration, and having a plurality of mounting flanges extending from the general plane of the plate and adapted to supportably engage the tiles by engagement within the slots thereof, and wherein the mounting flanges comprise two set of flanges, each set of flanges extending along a line se that the two lines of flanges are generally parallel, a first one of said sets including flanges to be engaged by the tile with inclined flange portions projecting at an acute angle away from the general plane of the plate so that upon installation of one of the tiles thereon by location within one of the slots thereof, the flange portion is resiliently deformed to securely engage the tile when the other slot thereof is engaged, after the flange of said one set, with a corresponding one of the flanges of the other set.

This is also a dry system which does not allow for the pouring of concrete to secure said bricks and in fact is very undesirable because of the exposure to the elements.

In contradistinction, the overlapping arrangement of the stepped blocks of the present invention also serve alleviate the problem of damp inner walls by physically blocking the penetration of wind driven rain.

The system of the present invention requires that a plurality of horizontal-axis rails be attached at accurate vertically-spaced intervals to the wall being faced. Accurate vertical spacing can be achieved without difficulty by several methods, three of which are suggested here.

After attachment of a first rail, a second rail can be suspended from the first rail by means of a pair of spacer bars, which are subsequently removed for reuse after the second rail is attached.

A second method is to provide vertical metal members to which the horizontal rails are attached at pre-determined intervals. Said vertical members remain as part of the wall and are subsequently covered with concrete. Their cost recovered by assigning a stress-taking task to the resulting metal array, and reducing the quantity of other material used in constructing the wall being clad.

A third method is to use a drilling template for drilling a first array of holes, whereafter the template is moved on for drilling a second array. Some overlap is provided to allow locator pins to be inserted in two holes of the first array and thus accurately position the template for the drilling of the second array.

As will be realized the system of the present invention can also be used in a context wherein said wall to be faced is formed from a plurality of inner blocks arranged as superposed courses and in fact the present system can be used to create prefabricated walls which can be prepared on site or in a factory and then shipped to the building site for erection.

Thus the present invention also provides a system for the stone cladding of buildings as hereinbefore defined and described, wherein said wall to be faced is formed from a plurality of inner blocks arranged as superposed courses, said system further comprising a second plurality of horizontal axis vertically spaced apart rails attached support means which together form an inner framework occupying a plane substantially parallel to the plane to be formed by said first plurality of rails wherein each of said second plurality of rails is provided with means for directly or indirectly positioning and supporting a plurality of said inner blocks and wherein said first plurality of rails are attached to support means which are attached in turn in spaced apart relationship to said inner framework add wherein said concrete layer is poured between said facing blocks and said inner blocks to form the same into a unitary wall unit.

The invention also provides a prefabricated wall whenever prepared from the above system.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiment of the present invention only and are present in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
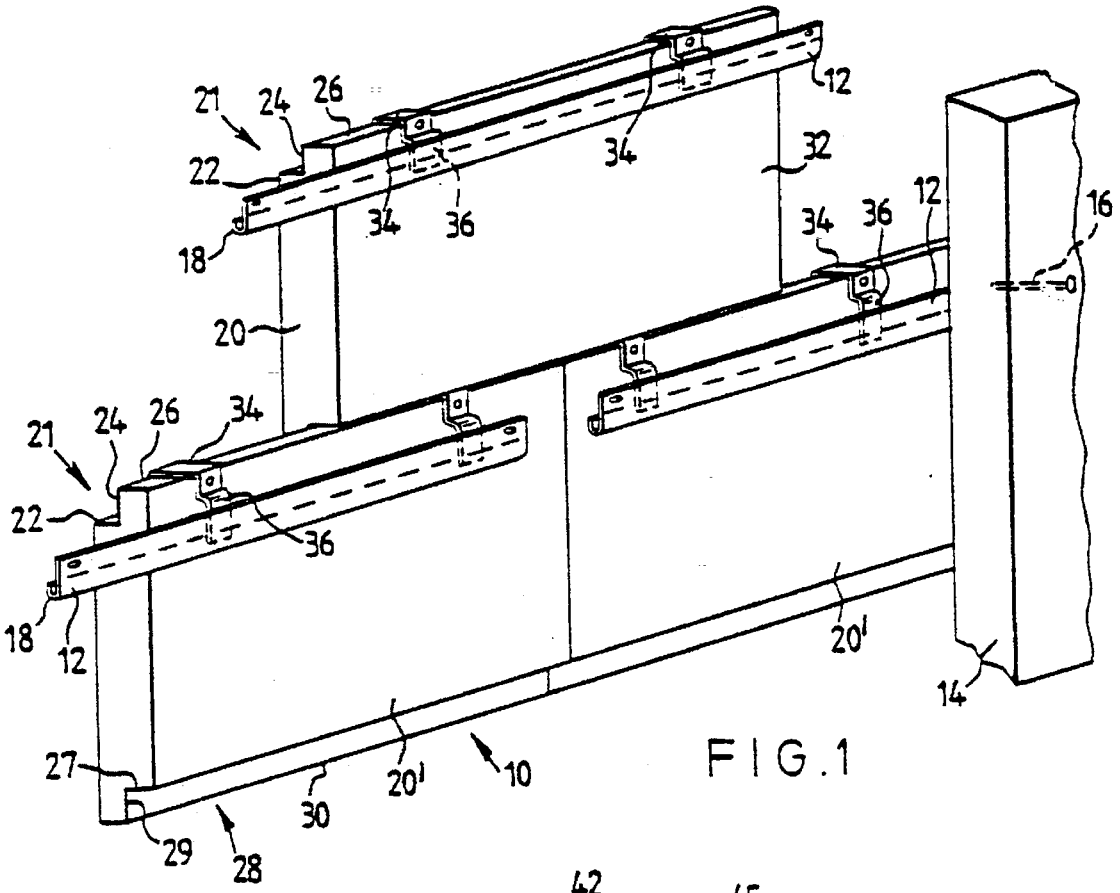
FIG. 1 shows a perspective rear view of a preferred embodiment of a cladding system according to the invention.

There is seen in FIG. 1 a system 10 for stone cladding of a building. A plurality of horizontal-axis, vertically spaced-apart rails 12 is configured to be attachable to wall 14 which is to be faced.

Rail 12 is preferably made of steel, and may be composed of several lengths, spaces being permissible between lengths.

Conventional fasteners 16 may be used for said attachment; however, the invention provides for preferred fastening hardware, which will be further described with reference to FIG. 2.

Rail 12 is provided with lip 18, having its open side facing upwards and away from wall 14, and serving to retain a course, or part of a course, of facing blocks 20.

A plurality of facing blocks 20 is arranged as superposed courses, each block 20 having a first step 21 defining a lower tread 22, a riser 24, and a top tread surface 26 extending along the length of the top surface of block 20. Block 20 is further provided with a complementary second step 28 extending along the length of bottom surface 27 thereof, and configured to interfit with said first step 21 of a block 20 positioned thereunder. Rear face 32 of block 20 is positioned in close proximity to rail 12.

Two connector brackets 34 are shown attached to each block 20 in side-to-side, spaced-apart relationship, each connector bracket 34 being provided with a downwardly-projecting extension 36 shown in engagement with lip 18 and, when engaged, holding block 20 firmly to rail 12 whereby said engagement of lip 18 with extension 36 enables the positioning and support of facing blocks 20. It is to be noted that the engagement of extension 36 with lip 18 does not limit the longitudinal positioning of facing block 20. Said engagement also still leaves some freedom in the vertical plane for facing block 20 to seat itself on block 20 below, and thereby, fast build-up of facing blocks is possible by workmen who are required only to hand each succeeding block adjacent to and above previously-laid blocks.

After an appropriate number of courses of blocks are erected a layer of concrete (not shown) is then poured behind facing blocks 20.

Figure 2:
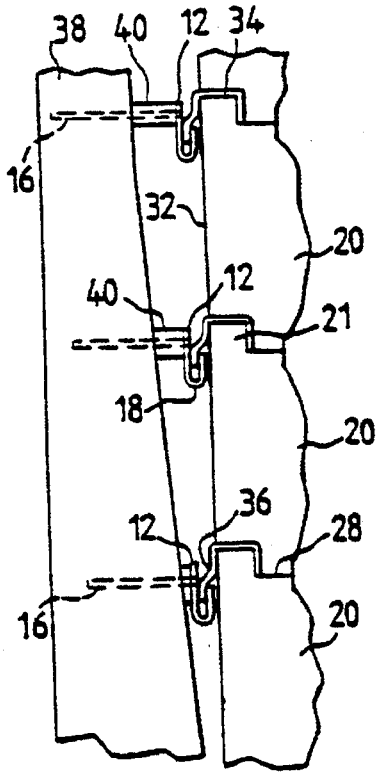
FIG. 2 is an end view of the system of FIG. 1, with added spacer members used when cladding a sloping wall.

FIG. 2 shows a system for stone cladding of buildings similar to that previously described above. Similar numerals are used to designate similar parts. There is shown attachment of rails 12 to wall 38, which is slightly sloped or stepped. Facing stones 20 are arranged in a true vertical plane, which arrangement is achieved by the addition of spacer members 40 introduced between wall 38 and rail 12.

Figure 3:
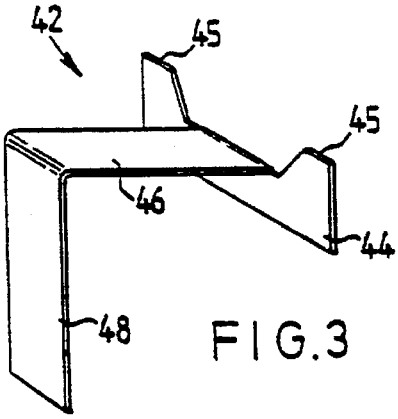
FIG. 3 is a perspective view of a connector bracket for use in the present invention.

FIG. 3 shows a preferred bracket 42 before assembly, for attachment of rail 12 to wall 14, as applied to systems for stone cladding of buildings described above with reference to FIG. 1.

The lower part of the face 44 of said bracket is configured to override riser 24 of block 20 of FIG. 1 (not shown) while horizontal component 46 overrides top tread surface 26, the tail section 48 of the bracket 42 being shaped for engagement with lip 18 of rail 12. In this preferred embodiment the upper part of face 44 is configured like two upwardly extending U or V-shaped arms 45 bracketing said horizontal component 46 and designed to be inserted in groove 62 of a block 68 as described with reference to FIG. 5 hereinafter and thereby providing greater stability to the block placed thereabove. The bracket is designed for manufacture from sheet metal in a press.

Figure 4:
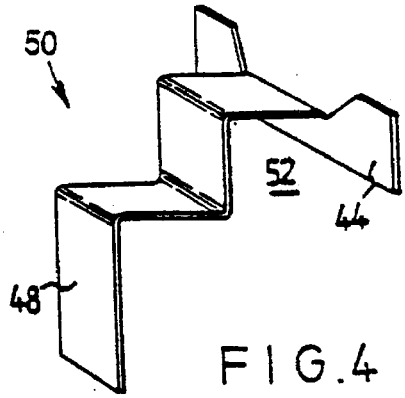
FIG. 4 is a perspective view of a modified connector bracket for use in the present invention.

FIG. 4 shows a connector bracket 50 similar to the bracket 42. It is however provided with an inverted U shaded section 52 configured to engage the step 21 seen in FIG. 1 by overriding and bracketing riser 24, top tread surface 26 and part of rear face 32 of said block.

Figure 5:
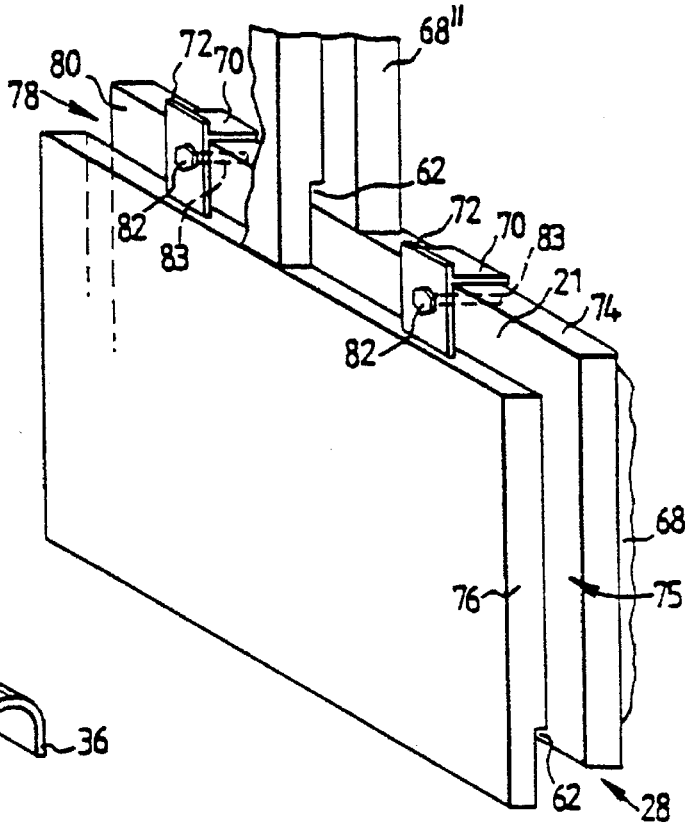
FIG. 5 is a perspective view of a facing block and connector bracket.

FIG. 5 shows a further preferred embodiment of the facing block and connector bracket, applicable to the system for stone cladding of buildings described above with reference to FIG. 1.

Facing block 68 is provided with a first groove 62. Connector bracket 70 is provided with an upward projection 72, extending above the top tread surface 74 and sized to engage first groove 62 of facing block 68", shown fragmented, placed thereabove. Connector bracket 70 is also provided with a downwardly-projecting extension 36, shown in FIG. 1.

Facing block 68 is provided with steps 21 and 28, as seen in FIG. 1, and additionally with a third step 75 along a first edge 76, coplanar with and contiguous to first step 21; and fourth step 78 along a second side edge 80, coplanar with and contiguous to the second step 28; third step 75 being configured to interfit with the fourth step 78 of an adjacent similar block 68'(not shown).

The above arrangement has the advantage of securing adjacent facing blocks to each other. The overlapping arrangement: made possible by side steps 75 and 78 enables the use of a course of blocks according to the present invention as a form work surface for poured concrete in a wet system which is not possible with the stepped stones described in the dry system of Israel Patent 92423. Furthermore, connector brackets may be provided to every second block in a course, or only one bracket 70 may be provided for each block 68, thereby saving half of the expense associated with these brackets.

Connector bracket 70 may be further secured to block 68 by means of a fastener 82, a through-going aperture 83 being provided in block 68 to provide passage therefor.

Figure 6:
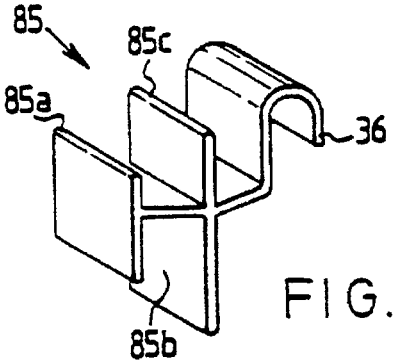
FIG. 6 is a perspective view of a further embodiment of a connector bracket attachable to a facing block.

There is seen in FIG. 6 a further embodiment of a connector bracket 85, attachable to a facing block such as 68, but: again having the advantage of not requiring drilled apertures in the block. The projection **85*a* shown on the upper left of the drawing is engageable to groove 62. Inverted U shape 85*b* is fitted to the top tread surface 74. Upper projection 85*c* serves to align a facing block placed, above bracket 85. The downwardly-projected extension 36 is insertable into lip 18 shown in FIG. 1. Connector bracket 85** is conveniently manufactured from steel or from an aluminum alloy extrusion.

Figure 7:
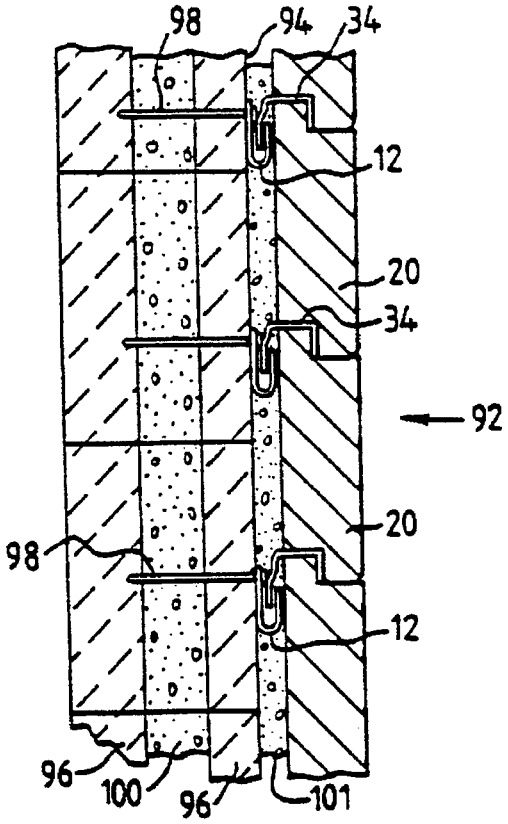
FIG. 7 is a cross-sectional side view, showing the present cladding system adapted to a foamed plastic wall.

FIG. 7 shows a cladding system 92, suitable for use on a wall having outer face 94 before cladding, and made of foamed plastic 96. Walls of this type are used to provide insulation for thermal, accoustic or water-resistant purposes.

Rails 12 are attached to outer face 94 by means of headed fastener rods 98, which penetrate plastic 96 and enter space which is subsequently filled with concrete 100. Facing blocks 20 are then built up, as described above with reference to FIG. 1 and then concrete 101 is poured into the space containing rails 12.

Figure 8:
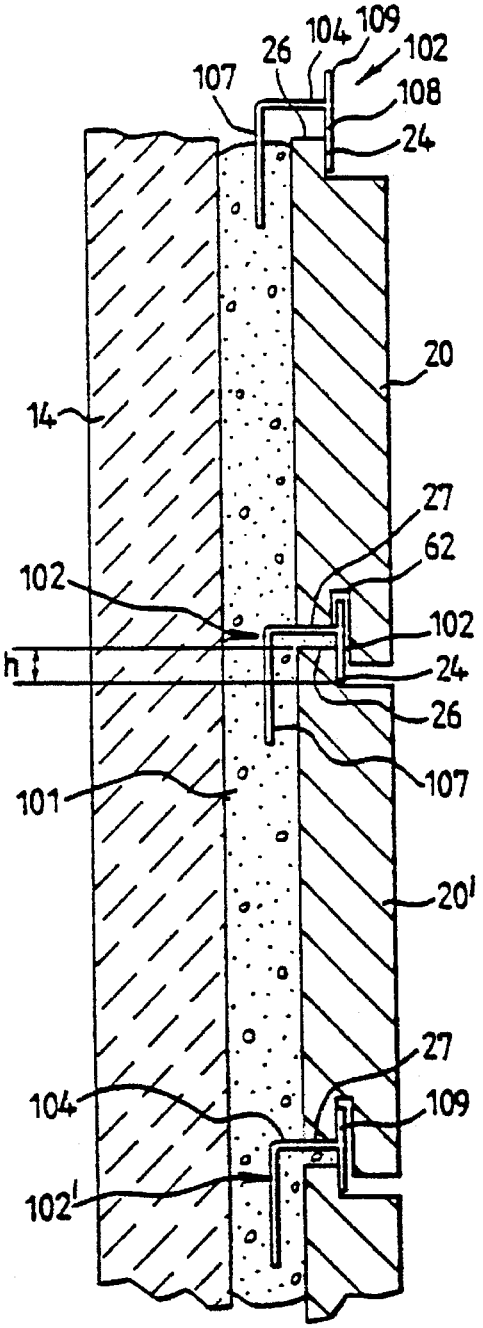
FIG. 8 is a cross-sectional side view of a further embodiment of a preferred rail in conjunction with preferred cladding blocks.

FIG. 8 shows an especially preferred rail 102 for use in the present invention with facing block 20 of FIG. 1 modified with groove 62 as shown in FIG. 5.

The rail is provided with a retention ledge 104 configured to underlie a bottom surface 27 of an upper block 20 as well as overriding the top tread surface 26 of a block 20' positioned thereunder and is further provided with a lower retention lip 108 projecting downwardly therefrom and exceeding the height h of the riser 24 of said block positioned thereunder, whereby said block may be inserted, lowered into and retained between a lower retention lip 108 of an upper rail 102 and a retention ledge 104 of a lower rail 102' and may be removed therefrom after lifting said block above said upper ledge. The rail anchor flange 107 is surrounded by concrete 101 and so provides full security against extraction. It is to be noted that the concrete 101 enters and fills the gap formed between the lower face of the retention ledge 104 and the top tread surface 26.

Said rail is preferably further provided, as shown, with an upward projection 109 coplanar and contiguous to said lower retention lip 108 and positioned and sized to engage the grooves 62 of a plurality of facing blocks 68 (as shown in FIG. 5) placed side by side thereabove.

Figure 9:
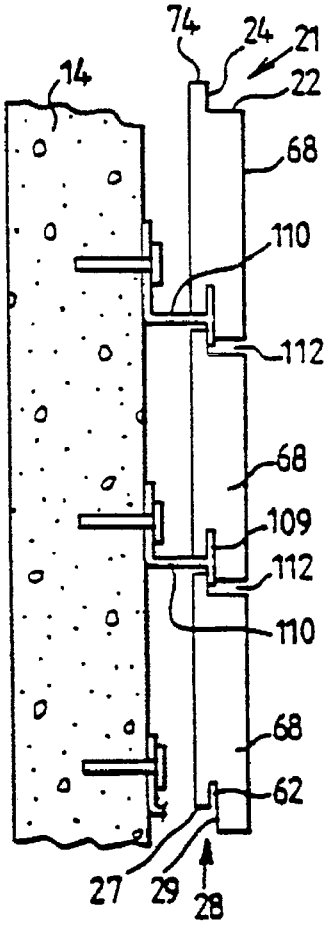
FIG. 9 is an end view of a further embodiment of the present invention.

In FIG. 9 there is seen a system for stone cladding, including a plurality of facing blocks 68 arranged as superposed courses, each block 68 having a first step 21 defining a lower tread 22, a riser 24, and a top tread surface 74 extending along the length of the top surface of the block. This block is further provided with a complementary second step 28 extending along the length of the bottom surface 27 thereof and configured to interfit with the first step 21 of a block positioned thereunder. Attached to the wall 14, to be faced, are a plurality of horizontal-axis, vertically spaced-apart rails 110, and a plurality of blocks 68 are retained by the rails 110 relative to previously laid blocks and relative to the wall 14. Advantageously, the facing blocks 68 are further provided with a groove 62 extending along the length of the bottom surface 27, a wall of the groove 62 being in contiguity with the riser 29 of the second step 28. The rail 110 is further provided with an upward projection 109 positioned and sized to engage the Grooves 62 of a plurality of facing blocks 68 placed side by side thereabove. If so desired, the gap 112 appearing between the courses may be filled with cement. However this filling operation may be dispensed with, and the gap 112 can be eliminated simply by slightly extending, at the block manufacturing stage, the depth of the riser 29. It will be noted that the overlapping steps provide excellent resistant to the ingress of water, even if the gap 112 is not filled in.

Figure 10:
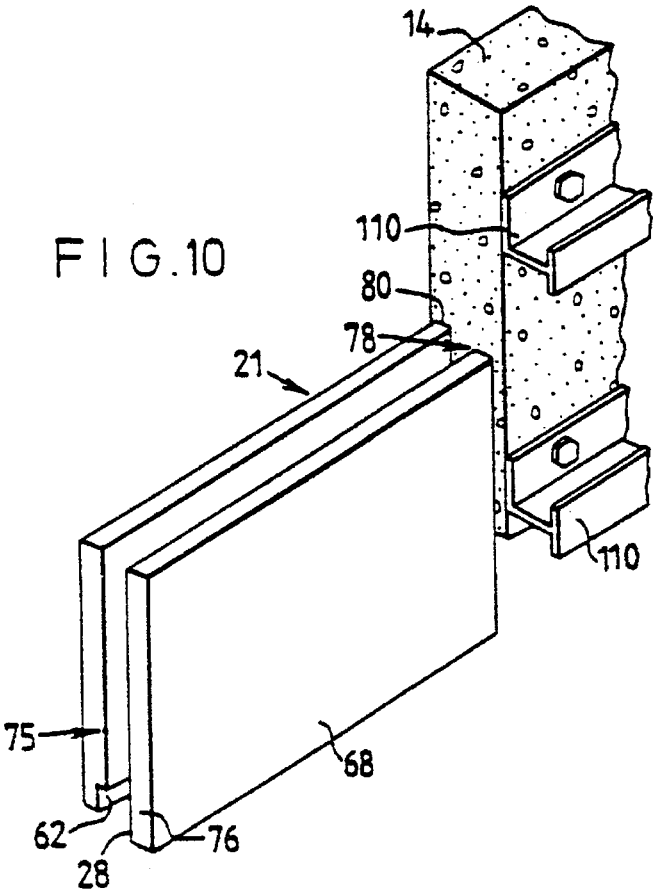
FIG. 10 shows a perspective view, the block being shown separately, of a preferred embodiment of a system for stone cladding using double stepped blocks.

FIG. 10 shows a system for stone cladding similar to that described with reference to FIG. 9, but provision is additionally provided to deter the entry of water into the gaps between horizontally adjacent facing blocks. As FIG. 9, there is attached to the wall 14 to be faced a plurality of horizontal-axis, vertically spaced-apart rails 110, and a plurality of blocks are retained by the rails 110 relative to previously laid blocks and relative to the wall 16. The facing blocks 68 are as shown with reference FIG. 5 and are provided with a third step 75 along a first side edge 76 coplanar and contiguous to the first step 21, and a fourth step 78 along a second side edge 80 coplanar and contiguous to the second step 28. The third step 75 is configured to interfit with the fourth step 78 of adjacent (not shown) similar block 68. A further advantage of the steps 75 and 78 is to accurately align in a row even those blocks 68 which due to slackness are not well aligned by the rail 110.

Figure 11:
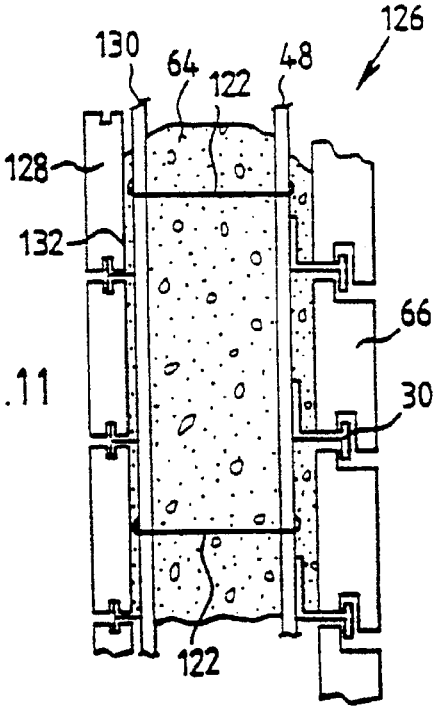
FIG. 11 is an end view of an embodiment of a prefabricated wall having light-weight stone blocks suspended on the room side of an inner metal framework.

There is seen in FIG. 11 an embodiment of a prefabricated wall 126. Light-weight cast stone blocks, 128, commonly known as "Etung" blocks, are suspended on the room side of an upper metal framework 130 having projection rails 132 for this purpose. Tierods 122 are used to connect the inner framework 130 in spaced-apart relationship to the rods 48 or rails 30 in a plane parallel to the plane formed thereby. Outer facing blocks 66 are suspended on the rails 30 in the same manner as described with relation to the previous figures. Concrete 64 is poured between the two steel frameworks, the liquid concrete 64 being retained between the facing blocks 66 and the light-weight inner stone blocks; 128. The tierods 122 obviate the need for scaffolding during pouring.

Figure 12:
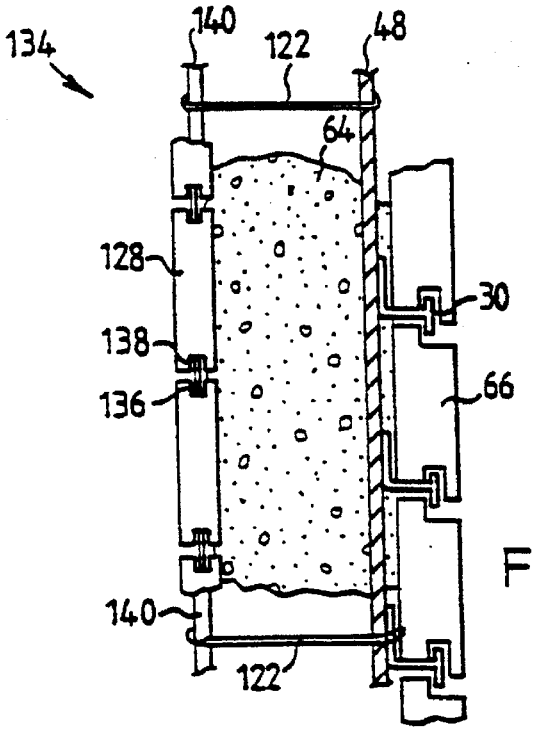
FIG. 12 is an end view of an embodiment similar to that of FIG. 11, but with the light-weight stone blocks being suspended inside the inner metal framework.

FIG. 12 shows a second embodiment of a prefabricated wall 134, similar to that described with reference to FIG. 11.

Light-weight inner stone blocks 128 are provided with grooves 136, 138 running along upper and lower edges, and an inner metal framework 140 is configured to allow insertion of the blocks 128 therein, so that the blocks 128 are suspended with part of the block thickness on both sides of the framework 140. The outer part of the wall is described with reference to FIG. 11. Concrete 64 is poured in the remaining space to complete the wall.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A system for stone cladding of buildings, comprising:

a plurality of facing blocks arrangeable as superposed courses, each block having a first step including a lower tread, a riser, and a top tread extending along a length of a top surface of the block and a second step having an top tread, a riser, and a lower tread extending along a length of a bottom surface of the block, each second step being configured to interfit with the first step of another of the blocks; and a plurality of rails configured to be attachable to a wall which is to be faced, each rail having a retention ledge configured to underlie the bottom surface of the blocks and override the top tread of the first steps, and a lower retention lip projecting downwardly from the retention ledge and having a height exceeding the height of the risers of the first steps.

2. A system for stone cladding of buildings, comprising:

a non-vertical wall to be clad;

a plurality of spacers attached to the wall in vertically spaced rows, each spacer having a first end connected to the wall and a second end spaced from the wall, the first ends of the spacers in different rows lying in different vertical planes and the second ends of all the spacers lying in a common vertical plane;

a plurality of horizontally extending, vertically spaced rails connected to the second ends of the spacers; and a plurality of facing blocks supported by the rails in superposed courses opposing the wall with a space into which a concrete layer can be poured between the facing blocks and the wall, each block including a first step having a lower tread, a riser, and a top tread extending along a length of a top surface of the block, and a second step having a top tread, a riser, and a lower tread extending along a length of a bottom surface of the block, each second step interfitting with the first step of another of the blocks.

3. A system as claimed in claim 2 wherein the wall has a stepped surface opposing the facing blocks.

4. A system as claimed in claim 2 wherein the wall has a sloping surface opposing the facing blocks.

5. A system for stone cladding of buildings, comprising:

a plurality of facing blocks arrangeable as superposed courses, each block having a first step including a lower tread, a riser, and a top tread extending along a length of a top surface of the block and a second step having a top tread, a riser, a lower tread extending along a length of a bottom surface of the block, and a groove formed in the top tread adjoining the riser, each second step being configured to interfit with the first step of another of the blocks;

a plurality of rails for attachment to a wall to be faced; and a plurality of connector brackets attachable to the rails for connecting the facing blocks to the rails, each bracket having a first leg, a second leg extending substantially perpendicularly from an end of the first leg, and a third leg extending substantially perpendicularly from an end of the second leg and having a lower portion opposing the first leg for engagement with the riser of one of the first steps and a pair of spaced apart arms extending upwards from opposite ends of the lower portion on opposite widthwise sides of the second leg for engagement with the groove of one of the second steps, a space between the first and third legs being configured to receive the top tread of one of the first steps.

6. A system as claimed in claim 5, further comprising:

a fourth leg extending substantially perpendicularly from an end of the first leg in an opposite direction from the second leg, and a fifth leg for engagement with one of the rails extending substantially perpendicularly from an end of the fourth leg.

7. A system for stone cladding of buildings, comprising:

a plurality of facing blocks arrangeable as superposed courses, each block having a first step including a lower tread, a riser, and a top tread extending along a length of a top surface of the block and a second step having a top tread, a riser, a lower tread extending along a length of a bottom surface of the block, and a groove formed in the top tread adjoining the riser of the second step, each second step being configured to interfit with the first step of another of the blocks;

a plurality of rails for attachment to a wall to be faced;

a plurality of connector brackets attachable to the rails for connecting the facing blocks to the rails, each bracket comprising:

a first plate having an upper portion for engagement with the groove of one of the second steps and a lower portion for opposing the riser of one of the first steps;

a second plate extending transversely from the first plate for disposition between the top tread of one of the first steps and the top tread of one of the second steps;

a third plate extending transversely from the second plate and substantially parallel to the first plate and having an upper portion and a lower portion extending in opposite directions from the third plate, a space between the first plate and the lower portion of the third plate being configured to receive the top tread of one of the first steps and a space between the first plate and the upper portion of the third plate being configured to receive the top tread of one of the second steps;

a fourth plate extending transversely from the third plate on an opposite side of the third plate from the second plate; and an engaging portion connected to the fourth plate for connecting the bracket to one of the rails.

8. A system for stone cladding of buildings comprising:

an inner framework;

a plurality of vertically spaced, horizontally extending inner rails mounted on the inner framework;

an outer framework parallel to and horizontally spaced from the inner framework and having an inner side facing the inner framework and an outer side facing away from the inner framework;

a plurality of vertically spaced, horizontally extending outer rails mounted on the outer side of the outer framework;

a plurality of inner facing blocks supported by the inner rails in a plurality of courses and forming an inner wall;

a plurality of outer facing blocks mounted on the outer rails in superposed courses and forming an outer wall, each outer facing block having a first step including a lower tread, a riser, and a top tread extending along a length of a top surface of the outer facing block and a second step having an top tread, a riser, and a lower tread extending along a length of a bottom surface of the outer facing block, each second step being configured to interfit with the first step of another of the outer facing blocks; and a layer of concrete extending from the inner wall to the outer wall.

9. A system as claimed in claim 8 wherein the inner and outer frameworks are embedded in the layer of concrete.

10. A system as claimed in claim 8 wherein the outer framework is embedded in the layer of concrete and the inner framework is disposed outside the layer of concrete.

11. A system as claimed in claim 8 wherein the inner facing blocks straddle the inner framework in a thickness direction of the inner facing blocks.

12. A method for stone cladding comprising:

forming a vertical inner framework and a vertical outer framework horizontally spaced from the inner framework;

disposing a plurality of vertically spaced, horizontally extending inner rails on the inner framework and a plurality of vertically spaced, horizontally extending outer rails on an outer side of the outer framework facing away from the inner framework;

disposing a plurality of inner facing blocks on the inner rails in a plurality of courses to form an inner wall;

disposing a plurality of outer facing blocks on the outer rails in superposed courses to form an outer wall with each outer facing block having a first step on its upper surface interfitting with a second step on a lower surface of another of the outer facing blocks; and then forming a layer of concrete extending from the inner wall to the outer wall and embedding the outer framework.

13. A method as claimed in claim 12 including embedding the inner framework in the layer of concrete.

14. A system for stone cladding of buildings, comprising:

a plurality of horizontally entending, vertically spaced rails mounted on a wall which is to be faced;

a plurality of facing blocks supported by the rails in superposed courses opposing and spaced from the wall, each facing block having a foirst step with a lower tread, a riser, and a top tread extending along a length of a top surface of the facing block and a second step complementary to the first step and having a top tread, a riser, and a lower extending along a length of a bottom surface of the facing block and interfitting with the first step of a facing block in an adjoining course; and a concrete layer poured between the facing blocks and the wall.

15. A system as claimed in claim 14 wherein each rail has a retention ledge underlaying the second step of a plurality of the facing blocks and overriding the top tread of the first step of a plurality of the facing blocks, and a lower retention lip projecting downwardly from the retention ledge and exceeding the height of the risers of the first steps whereby each facing block may be inserted, lowered into and retained between the lower retention lip of one of the rails and the retention ledge of another of the rails.

16. A system as claimed in claim 14 including spacers connecting the rails to the wall.

17. A system as claimed in claim 14 wherein each rail has a lip with an open side facing upwards, the system further comprising a plurality of connector brackets each attached to one of the facing blocks and having a downwardly-projecting extension engaged with the lip in one of the rails.

18. A system as claimed in claim 17 wherein each connector bracket supports one of the facing blocks with a space between the one of the facing blocks and a vertically adjoining one of the facing blocks, and the space is filled by ingress of concrete from the poured layer.

19. A system as claimed in claim 14 wherein each facing block includes a third step and a fourth step along opposite side edges, the third step interfitting with the fourth step of an adjacent one of the facing blocks.

20. A system as claimed in claim 14 wherein each of the second steps includes a groove formed in its upper tread adjoining its riser and extending in a lengthwise direction of the step, and each rail includes a retention ledge underlying a bottom surface of a plurality of the facing blocks and overriding the top tread of the first step of a plurality of the facingblocks, a lower retention lip projecting downwardly from the retention ledg4e along the risers of the first steps of a plurality of the facing blocks, and an upwardly projection coplanar with and contiguous to the lower retention lip and engaging the grooves of a plurality of the facing blocks.

21. A system as claimed in claim 20 wherein the upper retention ledge and the upward projection support vertically adjoining ones of the facing blocks with a space therebetween, and the space is filled by ingress of concrete from the poured layer.

22. A method for stone cladding comprising:

providing a plurality of facing blocks each having a first step with a lower tread, a riser, and a top tread extending along a length of a top surface of the facing block, and a second step complementary to the first step and having a top tread, a riser, and a lower tread extending along a length of a bottom surface of the facing block;

attaching a plurality of horizontally extending, vertically spaced rails of a wall to be faced;

laying the facing blocks in superposed courses with the first step of each block interfitting with the second step of a block in an adjoining course and with both an upper surface and a lower surface of each facing block retained and positioned relative to previously laid facing blocks and to the wall by a pair of the rails; and pouring concrete between the wall and rear surfaces of the facing blocks with the interfitting of the steps of facing blocks in adjoining courses preventing seepage of the poured concrete between vertically adjoining facing blocks to an outer surface of the facing blocks.

* * * * *

UNITED STATES PATENT AND TRADEMARK OFFICE

CERTIFICATE OF CORRECTION

PATENT NO. : 5,634,305

DATED : June 3, 1997

INVENTOR(S) : Erlanger

It is certified that error appears in the above-indentified patent and that said Letters Patent is hereby corrected as shown below:

Column 12, Line 23, change "foirst" to --first--;

Line 27, after "lower" insert --tread--;

Line 65, after "facing" insert -- --;

Line 66, change "ledg4e" to --ledge".

Signed and Sealed this

Twentieth Day of January, 1998

*Attest:*

Bruce Lehman

BRUCE LEHMAN

*Attesting Officer*

*Commissioner of Patents and Trademarks*